US011565222B2

(12) United States Patent
Corti et al.

(10) Patent No.: US 11,565,222 B2
(45) **Date of Patent: *Jan. 31, 2023**

(54) MIXER BASE ASSEMBLY FOR MIXING VESSELS AND METHOD OF USE

(71) Applicant: Pall Corporation, Port Washington, NY (US)

(72) Inventors: Eric A. Corti, Worcester, MA (US); Timothy Keating, Cambridge (GB); Andrew J. Malloy, Hertfordshire (GB)

(73) Assignee: Pall Corporation, Port Washington, NY (US)

( * ) Notice: Subject to any disclaimer, the term of this patent is extended or adjusted under 35 U.S.C. 154(b) by 117 days.

This patent is subject to a terminal disclaimer.

(21) Appl. No.: 16/724,728

(22) Filed: Dec. 23, 2019

(65) Prior Publication Data

US 2021/0187457 A1 Jun. 24, 2021

(51) Int. Cl.
*B01F 13/08* (2006.01)
*B01F 15/00* (2006.01)
(Continued)

(52) U.S. Cl.
CPC ..... *B01F 33/452* (2022.01); *B01F 35/2132* (2022.01); *B01F 35/2133* (2022.01)

(58) Field of Classification Search
CPC ..... B01F 13/0818; B01F 13/0827; B01F 13/0872; B01F 15/00006; B01F 33/4532; B01F 33/452
See application file for complete search history.

(56) References Cited

U.S. PATENT DOCUMENTS 5,882,113 A 3/1999 Binder
5,885,113 A 3/1999 Bricaud
(Continued)

FOREIGN PATENT DOCUMENTS

CN 202876683 U 4/2013
CN 103945928 A 7/2014
(Continued)

OTHER PUBLICATIONS

Japanese Patent Office, Office Action in counterpart Japanese Patent Application No. 2020-167108, dated Oct. 19, 2021.
(Continued)

*Primary Examiner* — Elizabeth Insler
(74) *Attorney, Agent, or Firm* — Leydig Voit & Mayer, Ltd.

(57) ABSTRACT

A mixer base assembly is provided comprising: (a) a body having an upper end including a mating face for mixing vessel connection; a lower end including a cavity; a first side wall, a second side wall, a third side wall, and a fourth side wall; an inlet port arranged in the first side wall; an outlet port arranged in the third side wall; a sampling port arranged in the fourth side wall; a probe port arranged in the third side wall; and, a fluid mixing chamber having a bottom wall; (b) an impeller seat arranged in the cavity in the lower end of the body; and, (c) a levitating magnetic impeller arranged in the impeller seat, the impeller comprising a magnet, a base, and at least two blades, wherein the at least two blades extend above the bottom wall of the fluid mixing chamber into the fluid mixing chamber.

21 Claims, 17 Drawing Sheets

(51) Int. Cl.
*B01F 33/452* (2022.01)
*B01F 35/21* (2022.01)

(56) References Cited

U.S. PATENT DOCUMENTS

| | | | | |
|---|---|---|---|---|
| 8,328,410 | B1 | 12/2012 | Retamal | |
| 8,469,585 | B2 * | 6/2013 | Retamal | B01F 15/0261 366/149 |
| 9,784,163 | B2 | 10/2017 | Noren, IV et al. | |
| 10,059,914 | B2 * | 8/2018 | Watkins | C12M 41/32 |
| 10,920,185 | B2 | 2/2021 | Scibek et al. | |
| 2015/0273414 | A1 | 10/2015 | Rozy et al. | |
| 2017/0296988 | A1 | 10/2017 | Waggoner et al. | |
| 2019/0168901 | A1 | 6/2019 | Mueggenborg et al. | |
| 2021/0187456 | A1 | 6/2021 | Corti et al. | |

FOREIGN PATENT DOCUMENTS

| | | | |
|---|---|---|---|
| CN | 104689737 | A | 6/2015 |
| CN | 107208519 | A | 9/2017 |
| CN | 109312284 | A | 2/2019 |
| JP | 2006-122785 | A | 5/2006 |
| JP | 2017-51947 | A | 3/2017 |
| KR | 10-1124220 | B1 | 3/2012 |
| KR | 10-2015-0064698 | A | 6/2015 |
| KR | 10-2017-0029937 | A | 3/2017 |
| WO | WO 2006/120945 | A1 | 11/2006 |
| WO | WO 2008/040568 | A1 | 4/2008 |
| WO | WO 2018/162174 | A1 | 9/2018 |
| WO | WO 2019/180710 | A1 | 9/2019 |

OTHER PUBLICATIONS

Canadian Intellectual Property Office, Office Action issued in Canadian Patent Application No. 3,099,511, dated Feb. 21, 2022.

Chinese National Intellectual Property Administration, Office Action issued in counterpart Chinese Patent Application No. 202011251832.2, dated Jun. 23, 2022.

"LevMixer® System", Pall Biotech, pp. 1-5 (2018).

Ondrey, "Alfa Laval Launches Levitating Mixer", *Chemical Engineering*, pp. 1-2, (Nov. 9, 2010).

Korean Intellectual Property Office, Office Action issued in counterpart Korean Patent Application No. 10-2020-0148983, dated May 10, 2022.

* cited by examiner

MIXER BASE ASSEMBLY FOR MIXING VESSELS AND METHOD OF USE

BACKGROUND OF THE INVENTION

Mixing vessels are mounted to mixer bases for use. However, different mixing vessels have different shapes and/or configurations and can require specialized mixer bases for use.

The present invention provides for ameliorating at least some of the disadvantages of the prior art. These and other advantages of the present invention will be apparent from the description as set forth below.

BRIEF SUMMARY OF THE INVENTION

An embodiment of the invention provides a mixer base assembly comprising (a) a body having (i) an upper end including a mating face for mixing vessel connection; (ii) a lower end including a cavity; (iii) a plurality of side walls; (iv) an inlet port arranged in a side wall; (v) an outlet port arranged in a side wall; (vi) a sampling port arranged in a side wall; (vii) at least one probe port arranged in a side wall; and, (viii) a fluid mixing chamber having a bottom wall; (b) an impeller seat arranged in the cavity in the lower end of the body; and, (c) a levitating magnetic impeller arranged in the impeller seat, the impeller comprising a magnet, a base, and at least two blades, wherein the at least two blades extend above the bottom wall of the fluid mixing chamber into the fluid mixing chamber.

In another embodiment, a method for mixing fluid comprises connecting a mixing vessel to a mixer base assembly comprising (a) a body having (i) an upper end including a mating face for mixing vessel connection; (ii) a lower end including a cavity; (iii) a plurality of side walls; (iv) an inlet port arranged in a side wall; (v) an outlet port arranged in a side wall; (vi) a sampling port arranged in a side wall; (vii) at least one probe port arranged in a side wall; and, (viii) a fluid mixing chamber having a bottom wall; (b) an impeller seat arranged in the cavity in the lower end of the body; and, (c) a levitating magnetic impeller arranged in the impeller seat, the impeller comprising a magnet, a base, and at least two blades, wherein the at least two blades extend above the bottom wall of the fluid mixing chamber into the fluid mixing chamber; introducing fluid into the fluid mixing chamber, and rotating the magnetic impeller to mix the fluid in the fluid mixing chamber.

BRIEF DESCRIPTION OF THE SEVERAL VIEWS OF THE DRAWING(S)

FIG. 1 is an exploded top view of a mixer base assembly according to an embodiment of the invention, wherein the mixer base assembly comprises a body comprising a fluid mixing chamber, two probe ports, a sample port, an inlet port, an outlet port, a vent inlet port, and a vent outlet port, the mixer base also comprising a levitating magnetic impeller, and an interface plate including an impeller seat, two probes, an inlet connector, an outlet connector, a vent filter, a sample port plug including a sealing gasket, a sample port nut, and fluid conduits.

Figure 1:
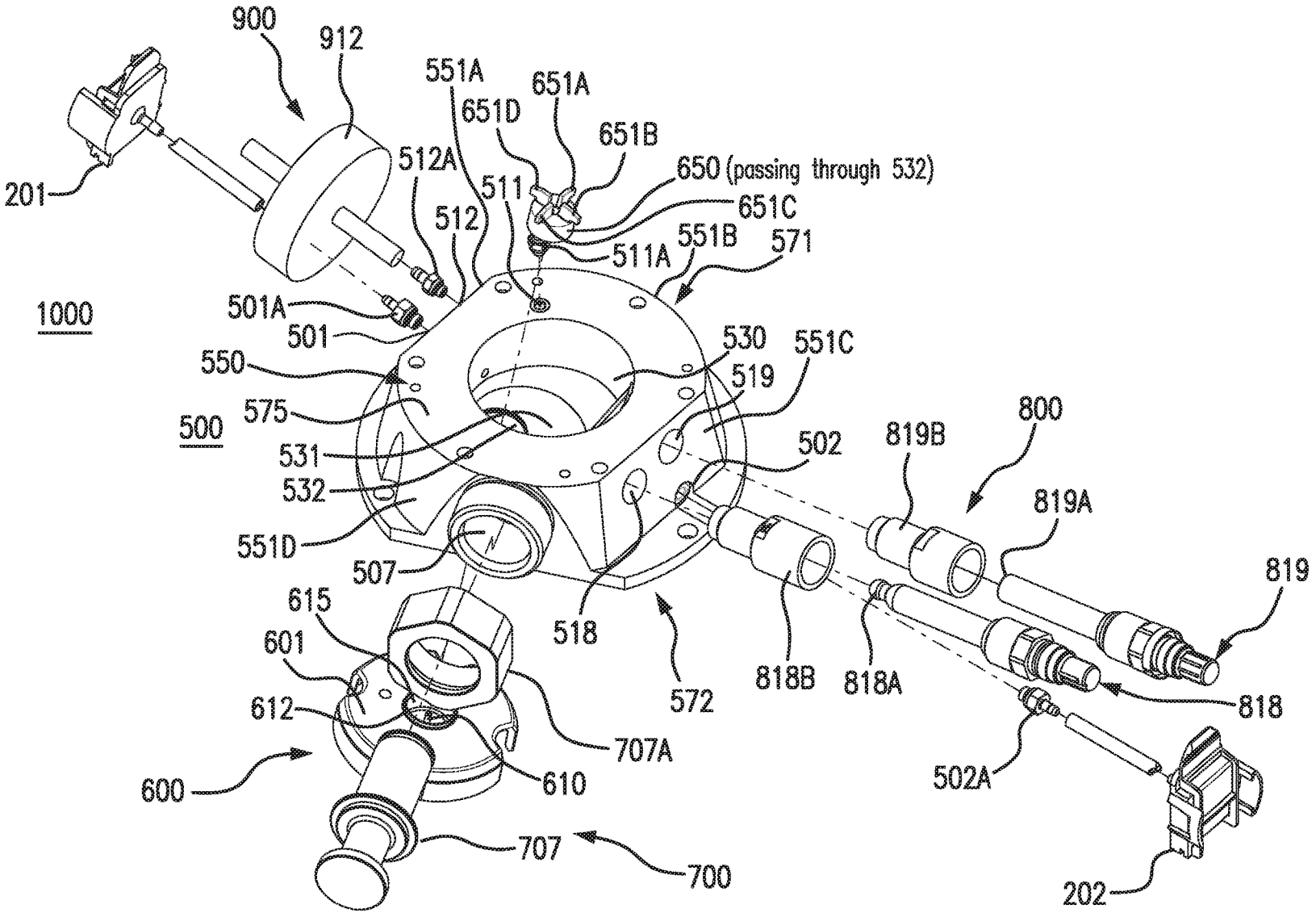
Figure 5:
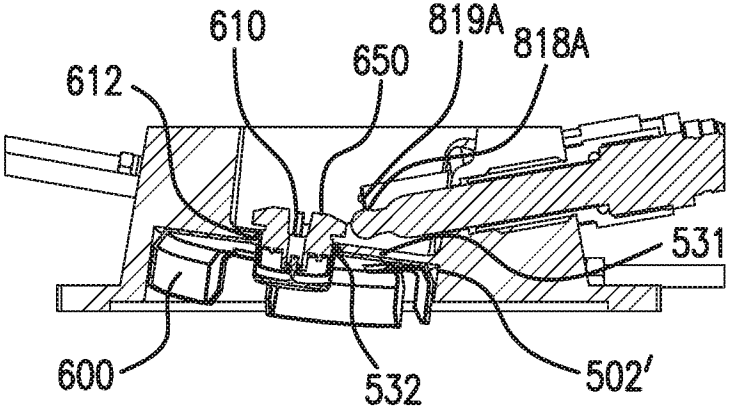

FIG. 5 shows a cross-sectional view of another portion of the mixer base assembly shown in FIG. 1, showing a downwardly sloped bottom wall of the fluid mixing chamber and the tips of two probes arranged to sense fluid parameters in the fluid mixing chamber, preferably wherein the slope toward the outlet port minimizes hold-up volume and/or helps create a taller height of fluid with a minimum volume to allow sensing of the fluid parameters. FIG. 5 also shows that the tips of the probes are angled downwardly into the fluid mixing chamber.

Figure 6:
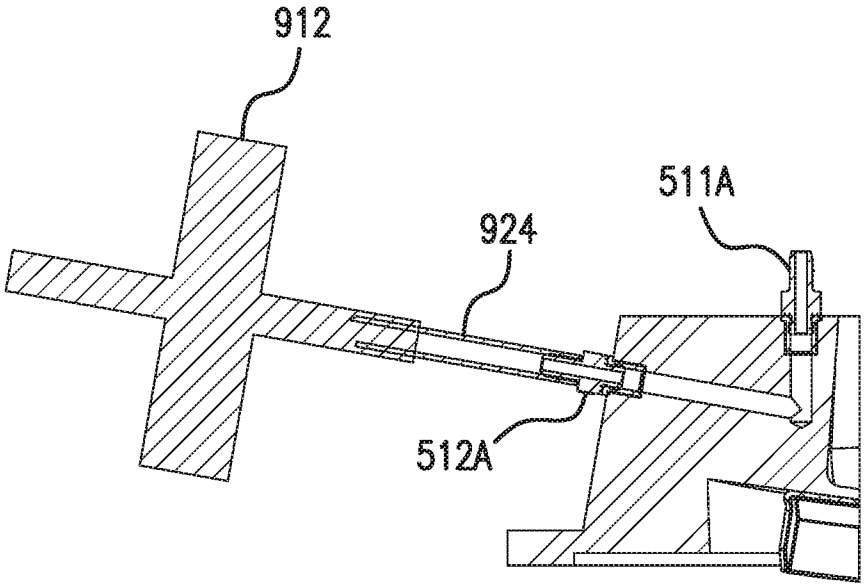

FIG. 6 is a partial cross-sectional view of another portion of the mixer base assembly shown in FIG. 1, showing a vent filter inlet port, a vent filter outlet port, a vent filter communicating with the vent filter outlet port, and fluid conduits.

Figure 7:
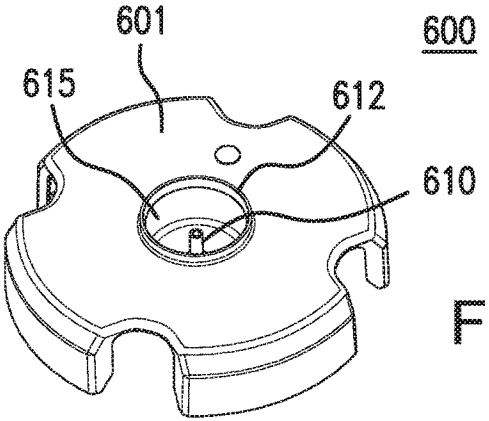

FIG. 7 is a top perspective view of the interface plate shown in FIG. 1, also showing the impeller seat.

Figure 8:
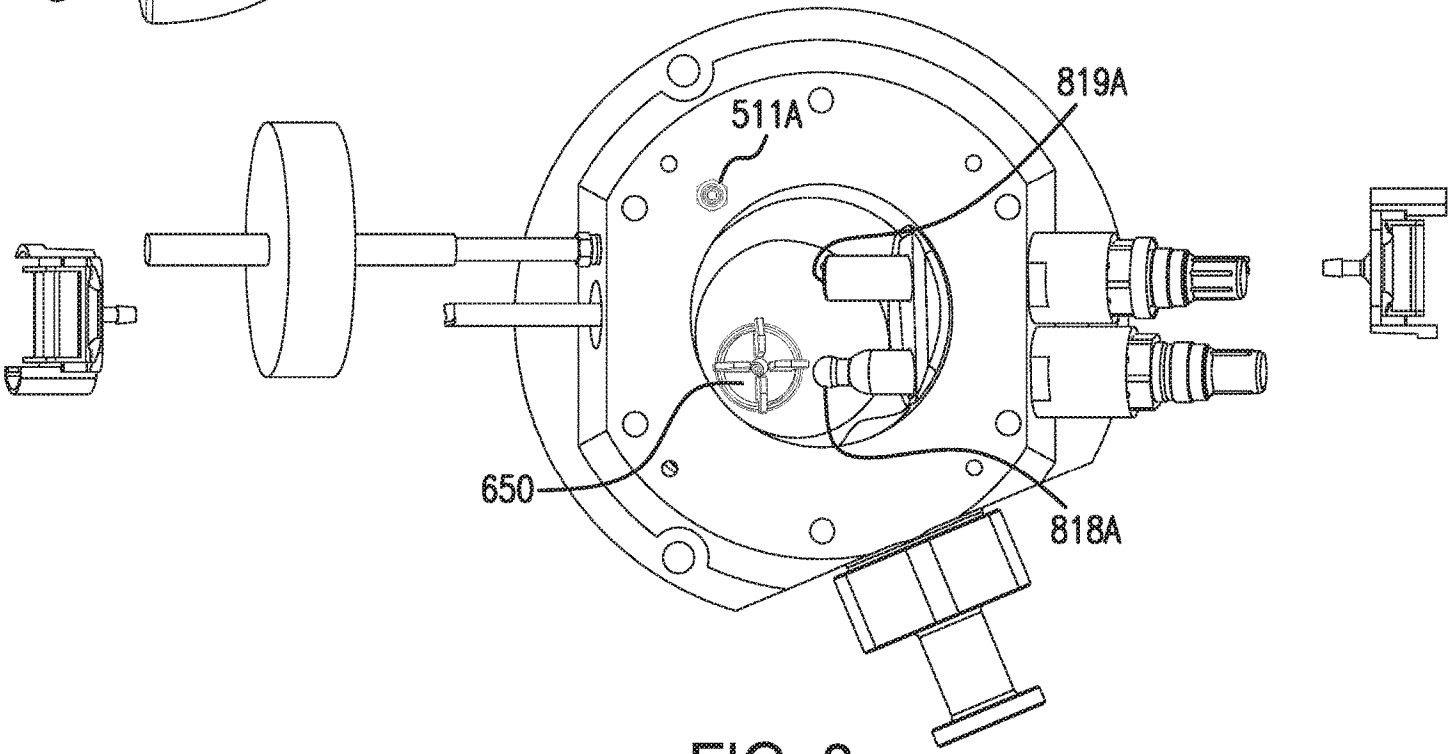

FIG. 8 is a partial top view of the mixer base assembly shown in FIG. 1, showing the body and the impeller.

FIGS. 9A, 10A, 11A, and 12A show embodiments of the mixer base assembly connectable to a variety of mixing vessels, wherein the mixer base assembly is docked into a hardware system (shown in FIGS. 13A-13D) containing electronics and a drive unit to rotate the impeller.

Figure 9A:
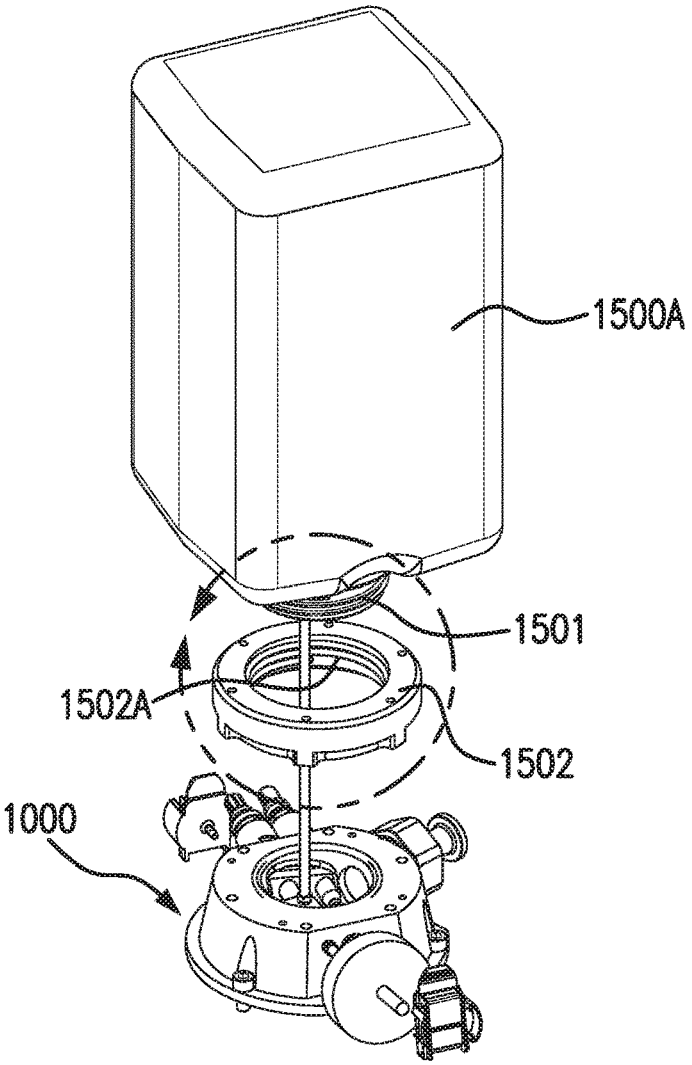
Figure 9B:
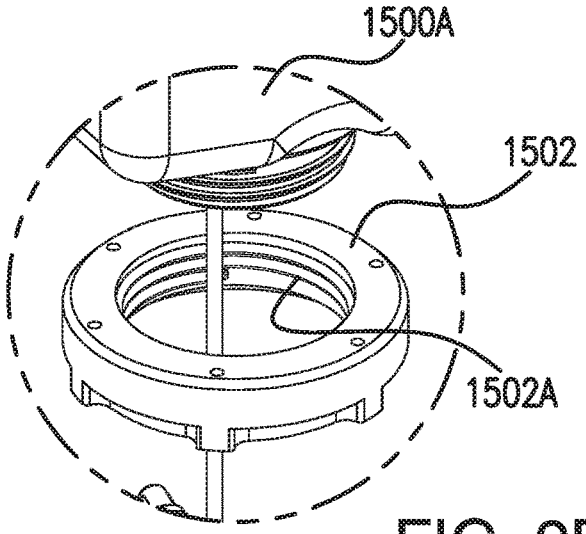
Figure 9D:
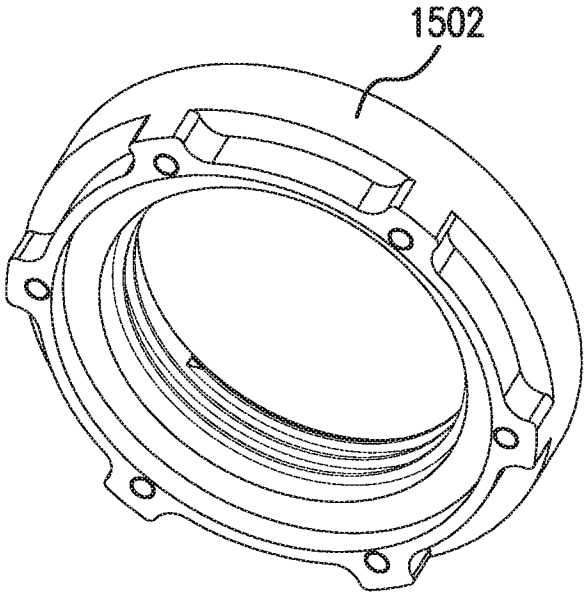
Figure 9C:
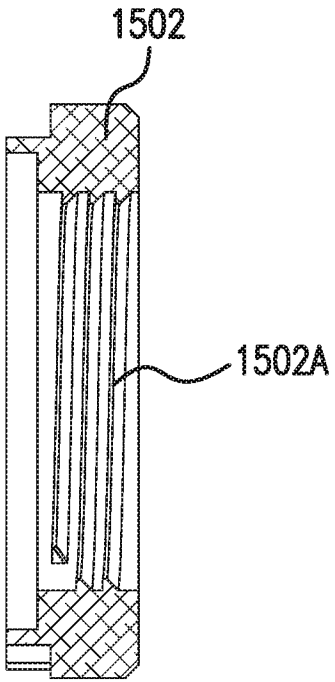
Figure 10A:
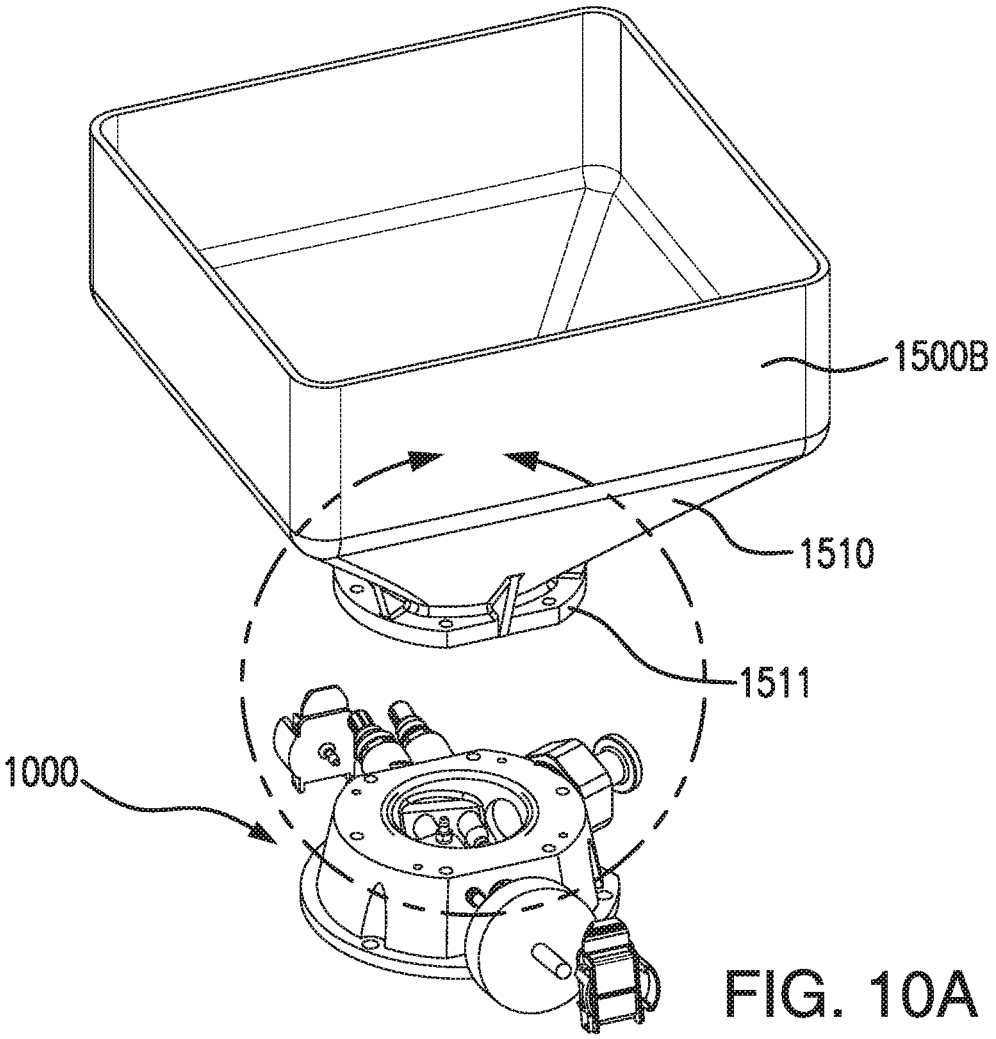
Figure 10B:
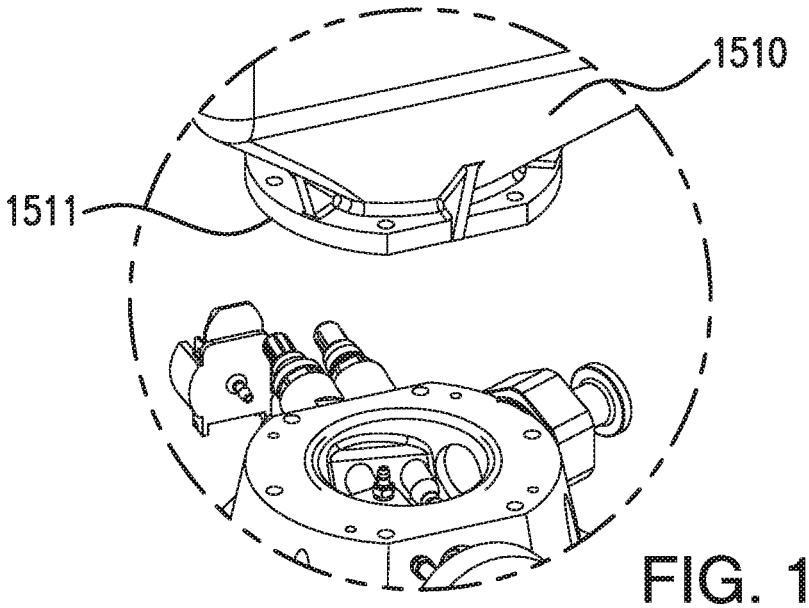
Figure 10C:
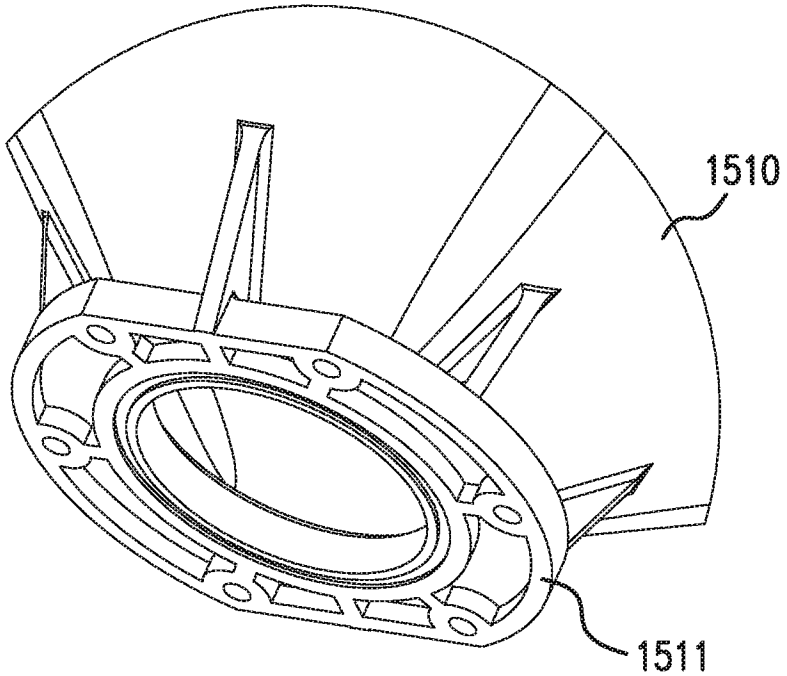

FIG. 9A shows an embodiment of the mixer base assembly connectable to a commercially available rigid mixing vessel, including a threaded mounting ring that can be threaded to the bottom of the mixing vessel and mated (e.g., by pins or screws or welding) to the mating face of the mixer base assembly; FIG. 9B shows an enlarged view of the threaded base of the mixing vessel and the mounting ring, FIGS. 9C and 9D show, respectively, a cross-sectional view, and a bottom perspective view, of the mounting ring FIG. 10A shows an embodiment of the mixer base assembly connectable to a custom molded rigid mixing vessel; FIG. 10B shows an enlarged view of the mounting flange at the bottom of the mixing vessel and the mating face of the mixer base assembly, wherein they can be mated together (e.g., by pins or screws); and FIG. 10C shows a perspective bottom view of the mounting flange at the bottom of the mixing vessel.

Figure 11A:
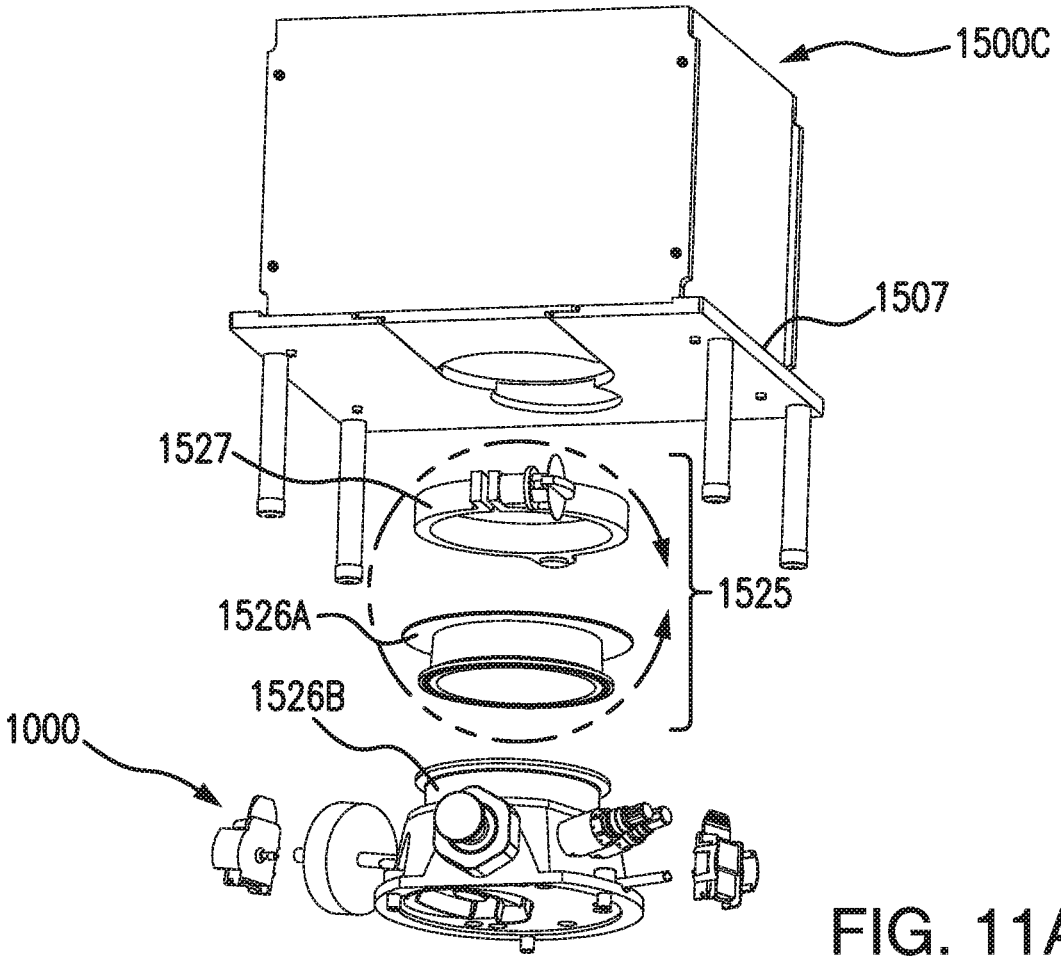
Figure 11B:
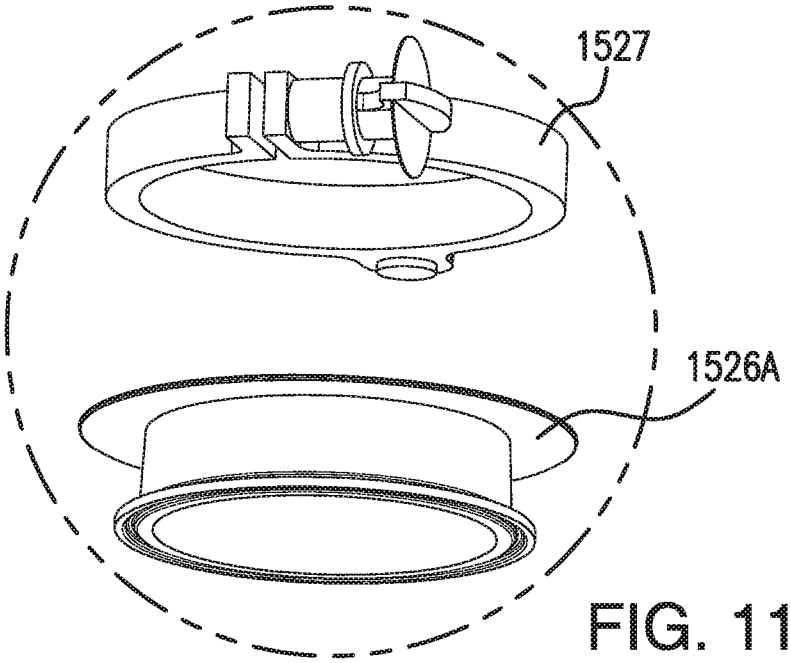
Figure 11C:
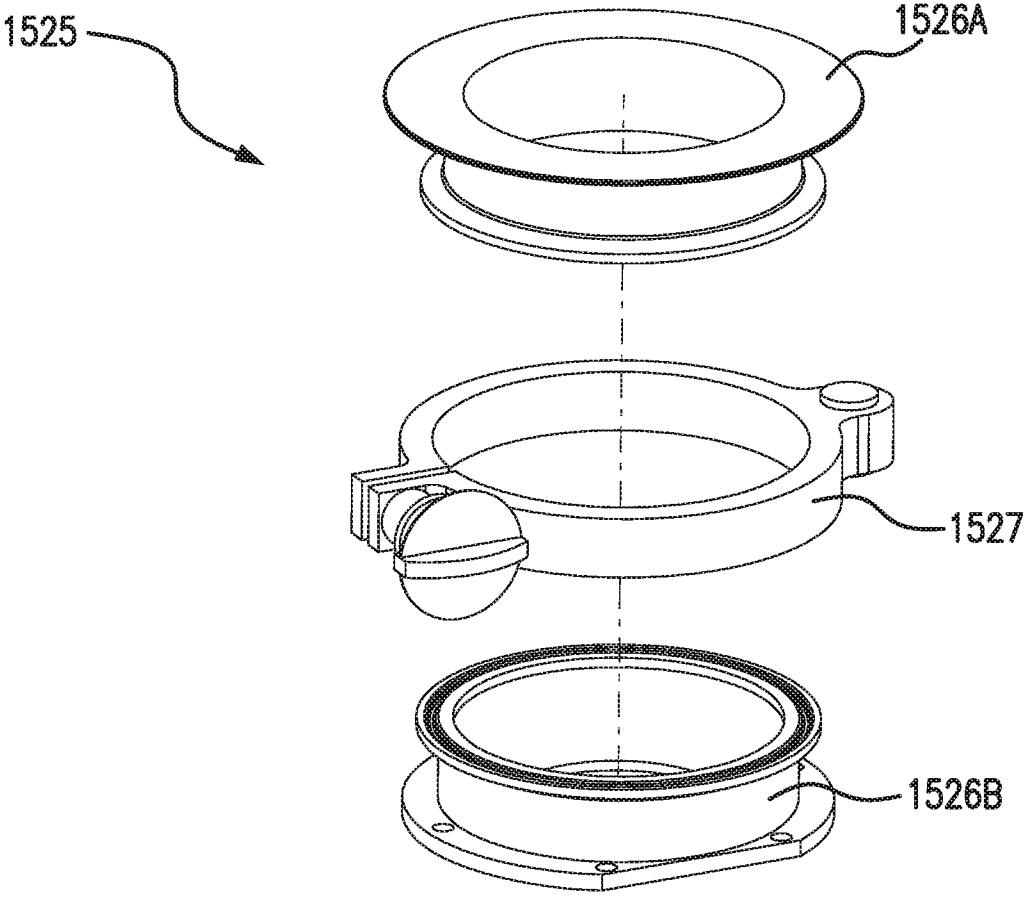

FIG. 11A shows an embodiment of the mixer base assembly connectable to a flexible mixing vessel (a biocontainer) arranged in a tote, including upper and lower sanitary flanges and a tri-clamp; FIG. 11B shows an enlarged view of the upper sanitary flange and the tri-clamp; and FIG. 11C shows an exploded view of the upper sanitary flange, the tri-clamp, and the lower sanitary flange (that can be mated, e.g., by pins or screws or injection molded as part of the body) to the mating face of the mixer base assembly.

Figure 12A:
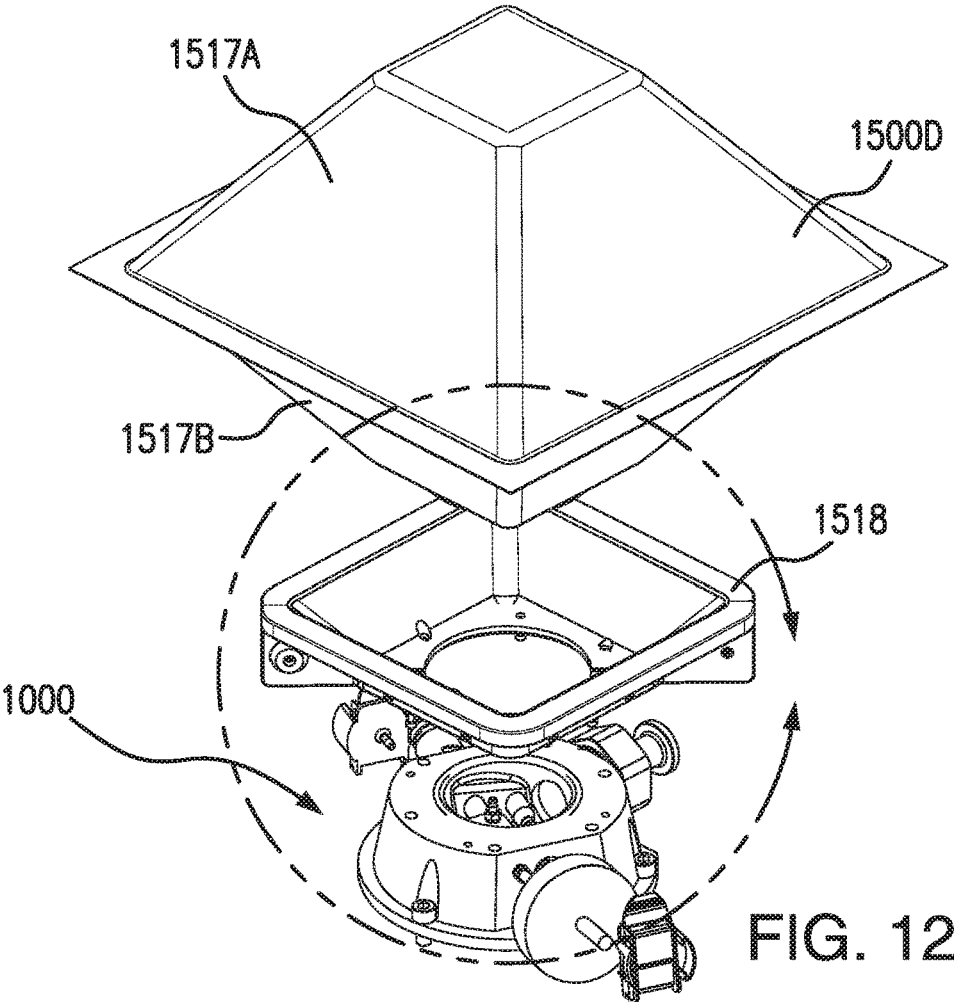
Figure 12B:
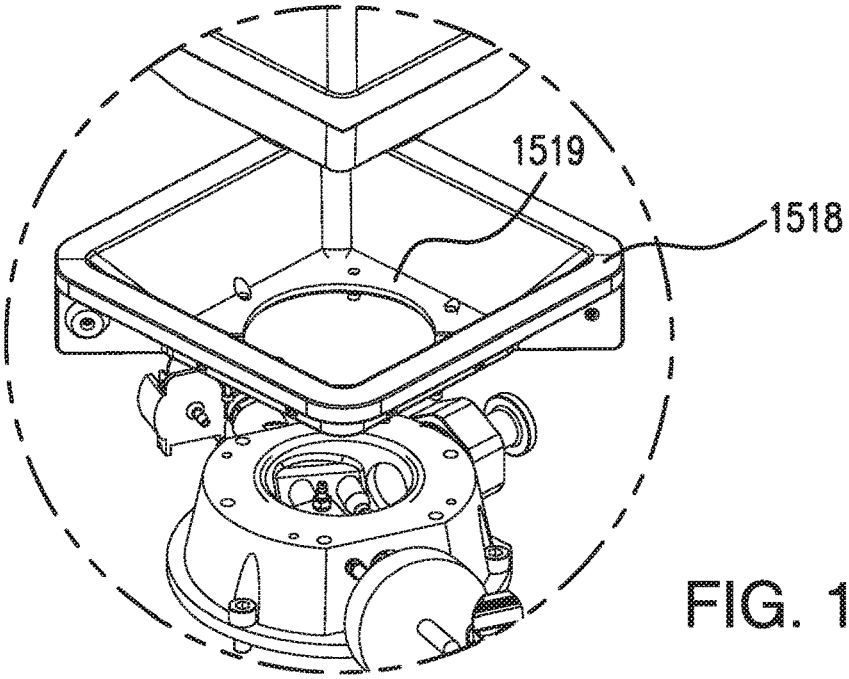
Figure 12D:
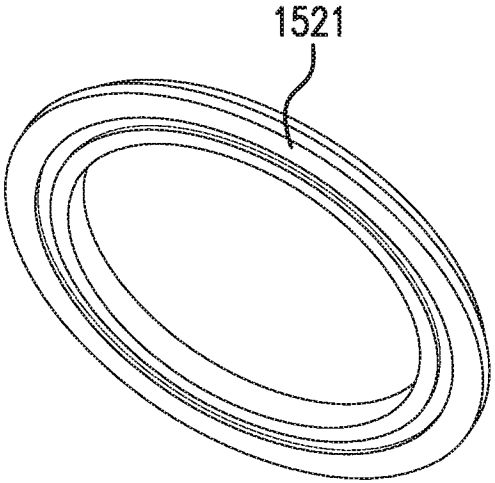
Figure 12C:
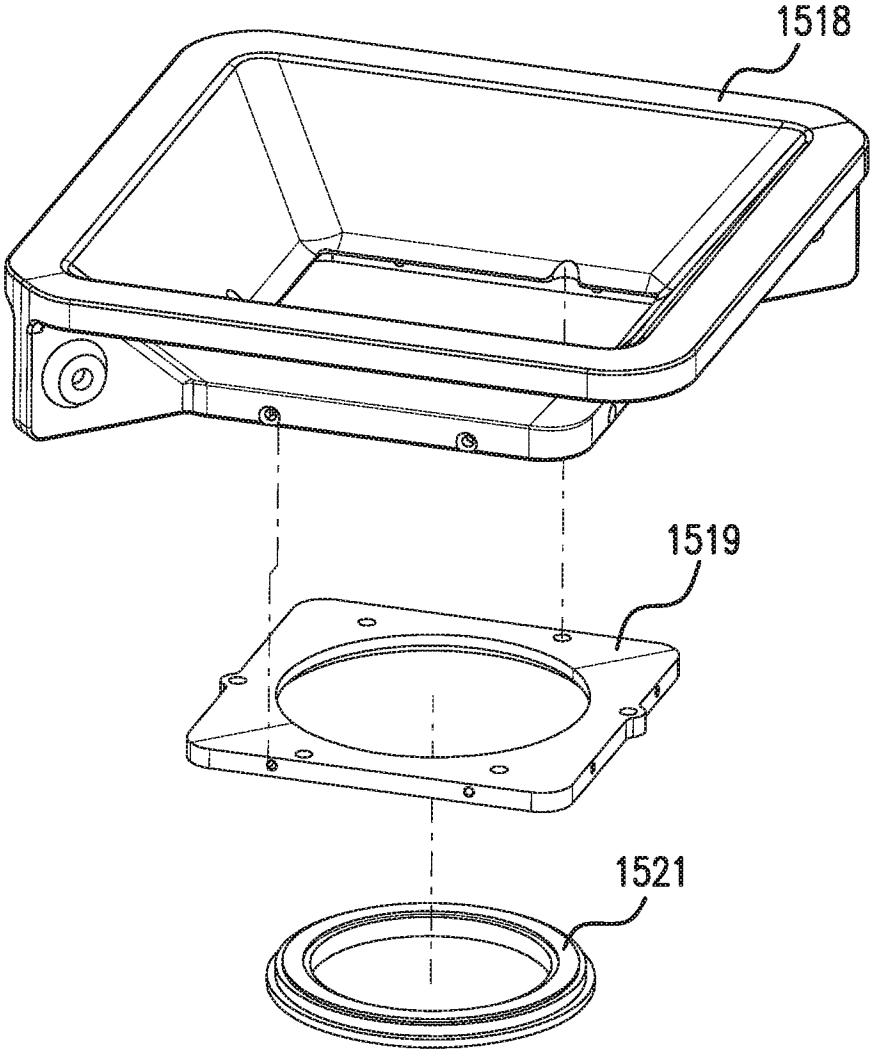

FIG. 12A shows an embodiment of the mixer base assembly connectable by an adapter to a custom vacuum formed mixing vessel having halves welded together, wherein the vessel can be rigid or flexible; also showing a mating flange connectable to the bottom of the mixing vessel and an adapter for connecting the mating flange to the mixer base assembly; FIG. 12B shows an enlarged view of the mating flange and adapter, FIG. 12C shows top perspective views of the mating flange, adapter, and a sealing ring providing a seal between the adapter and the mating face of the mixer base assembly; and FIG. 12D shows a bottom perspective view of the sealing ring.

Figure 13A:
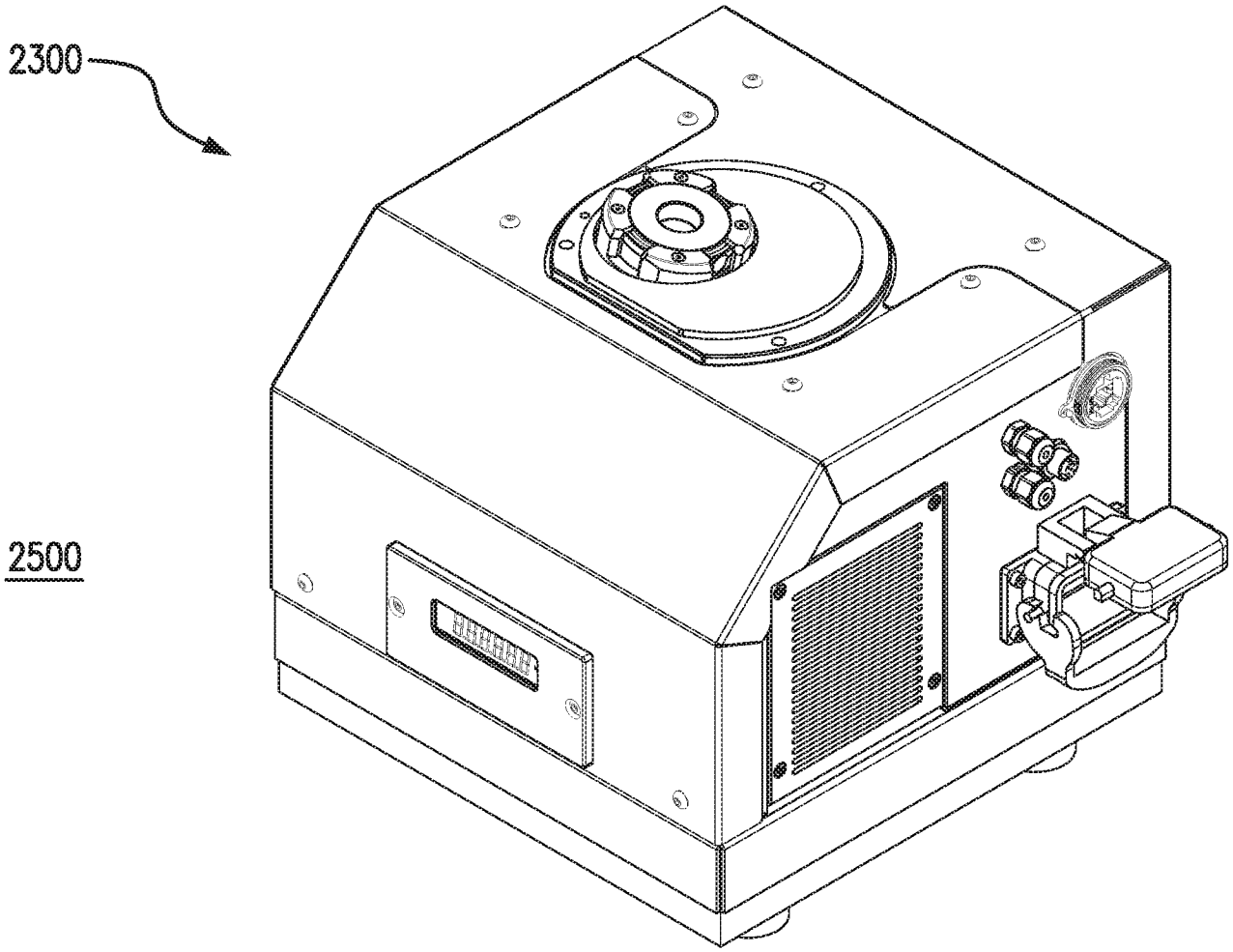
Figure 13B:
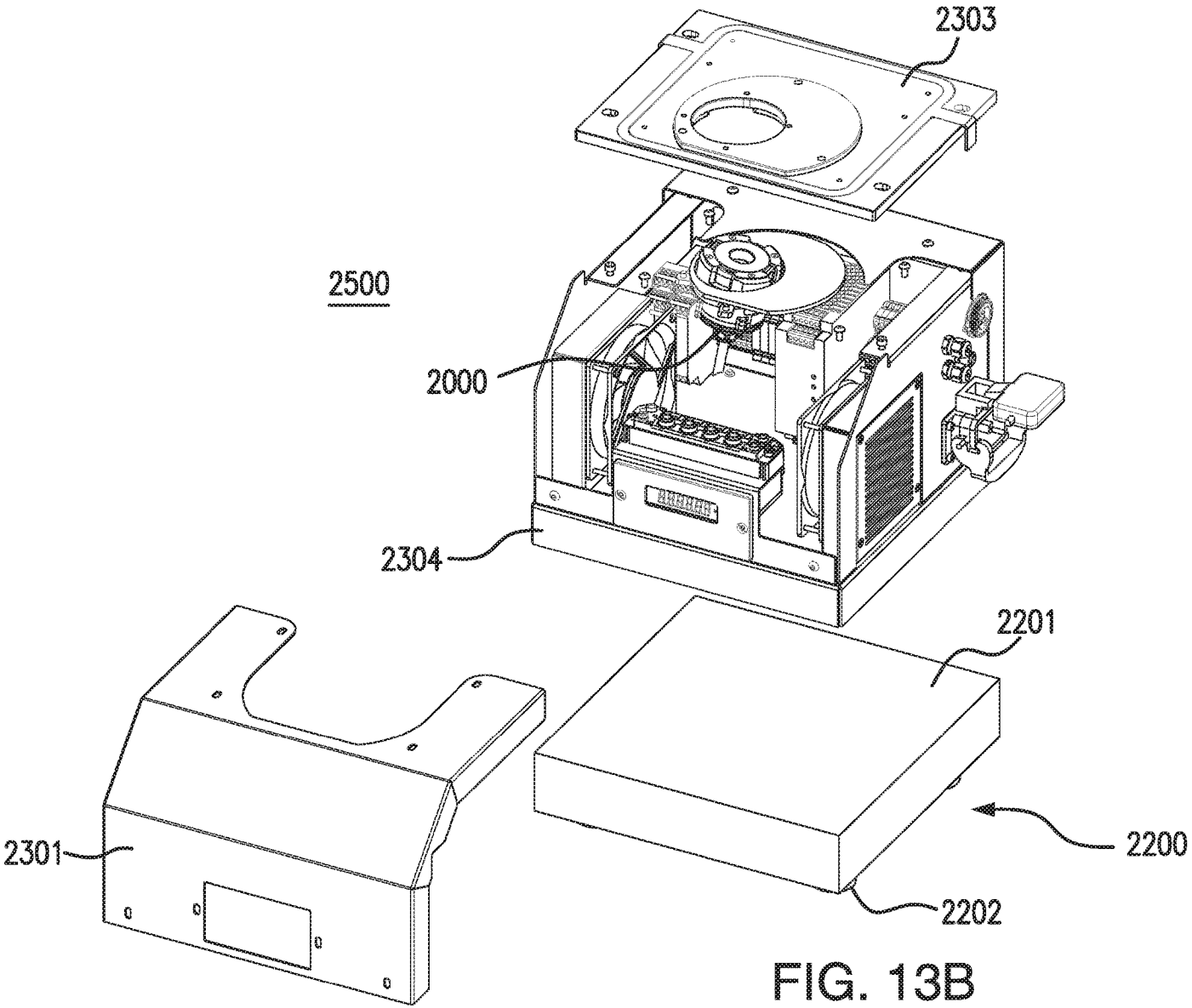
Figure 13C:
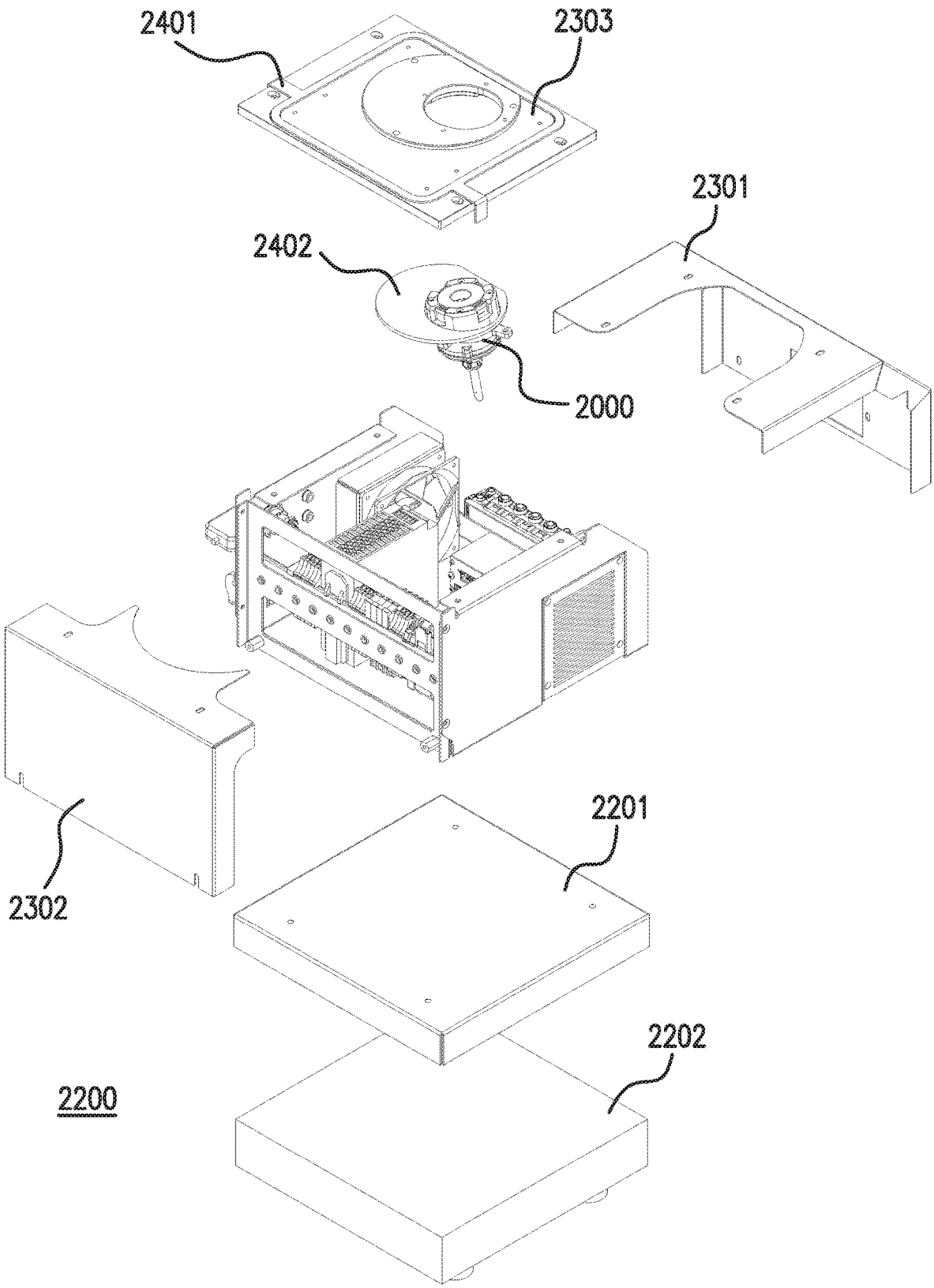
Figure 13D:
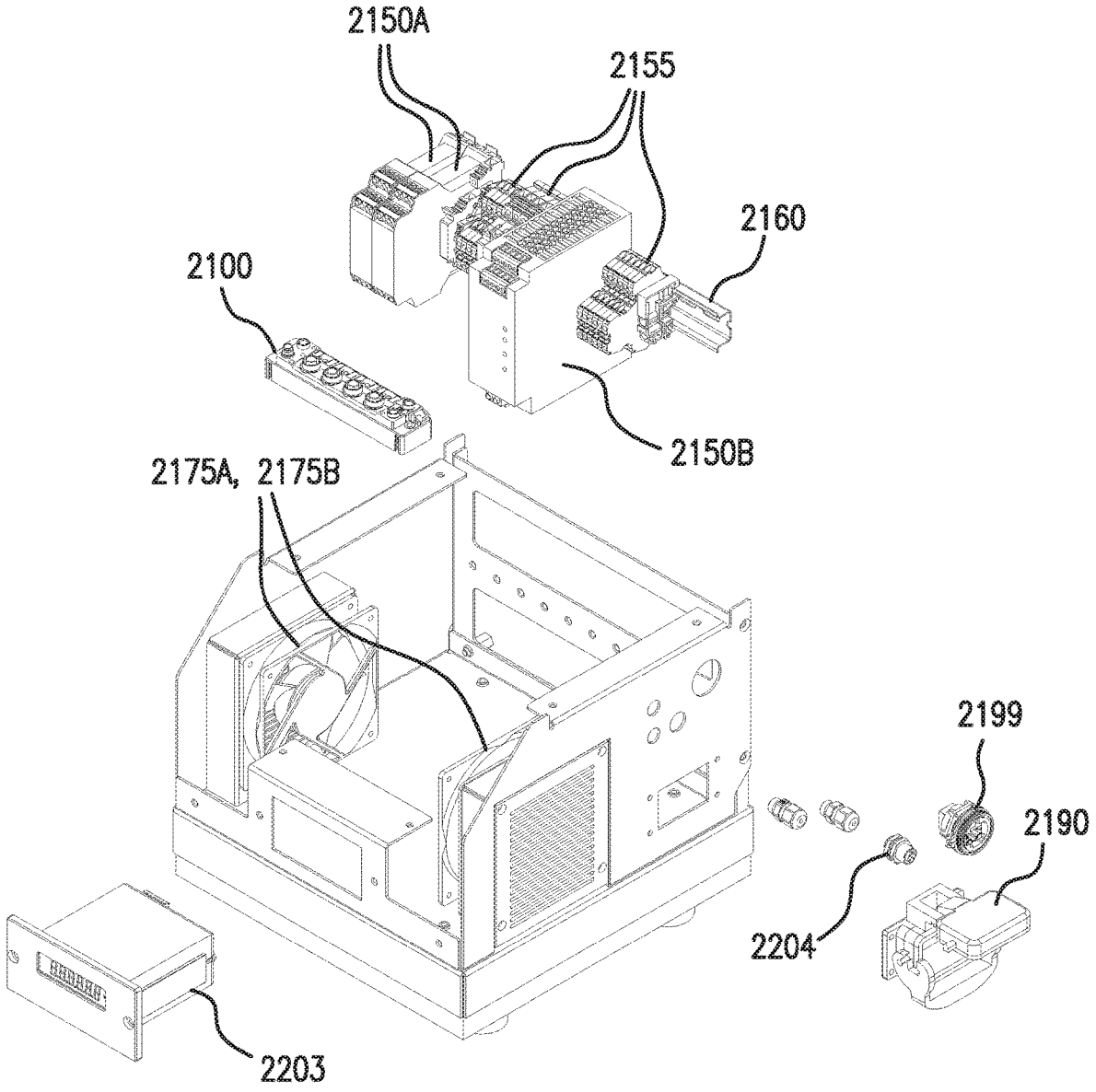

FIG. 13A shows an illustrative hardware system, FIG. 13B shows a front partially disassembled view of the hardware system shown in FIG. 13A, FIG. 13C shows a rear partially disassembled view of the hardware system shown in FIG. 13A, and FIG. 13D shows an internal view of the hardware system shown in FIG. 13A.

DETAILED DESCRIPTION OF THE INVENTION

In accordance with an embodiment of the invention, a mixer base assembly is provided comprising (a) a body having (i) an upper end including a mating face for mixing vessel connection; (ii) a lower end including a cavity; (iii) a plurality of side walls; (iv) an inlet port arranged in a side wall; (v) an outlet port arranged in a side wall; (vi) a sampling port arranged in a side wall; (vii) at least one probe port arranged in a side wall; and, (viii) a fluid mixing chamber having a bottom wall; (b) an impeller seat arranged in the cavity in the lower end of the body; and, (c) a levitating magnetic impeller arranged in the impeller seat, the impeller comprising a magnet, a base, and at least two blades, wherein the at least two blades extend above the bottom wall of the fluid mixing chamber into the fluid mixing chamber.

In some embodiments, the impeller seat is fluid tightly sealed to the bottom wall of the fluid mixing chamber. Alternatively, it can be included as part of the fluid mixing chamber (e.g., as a single, injection-molded part).

In a typical embodiment, the mixer base assembly includes two probe ports.

In some embodiments, the mixer base assembly further a vent inlet port and a vent outlet port, wherein the vent outlet port is arranged in a side wall of the body. In another embodiment, the vent outlet port is arranged in the body of the mixing vessel.

In a preferred embodiment, the bottom wall of the mixing chamber slopes downwardly toward the outlet port, and in a more preferred embodiment, the mixer base assembly further comprises at least one probe arranged in the at least one probe port, wherein a tip of the at least one probe (where the sensing element is located) is angled downwardly into the mixing chamber. In some embodiments, the mixer base assembly includes two probe ports, and two probes, each arranged in a separate probe port, wherein the tip of each probe is angled downwardly into the mixing chamber.

In another embodiment, a method for using a mixing fluid comprises connecting a mixing vessel to a mixer base assembly comprising (a) a body having (i) an upper end including a mating face for mixing vessel connection; (ii) a lower end including a cavity; (iii) a plurality of side walls; (iv) an inlet port arranged in a side wall; (v) an outlet port arranged in a side wall; (vi) a sampling port arranged in a side wall; (vii) at least one probe port arranged in a side wall; and, (viii) a fluid mixing chamber having a bottom wall; (b) an impeller seat arranged in the cavity in the lower end of the body; and, (c) a levitating magnetic impeller arranged in the impeller seat, the impeller comprising a magnet, a base, and at least two blades, wherein the at least two blades extend above the bottom wall of the fluid mixing chamber into the fluid mixing chamber; introducing fluid into the fluid mixing chamber, and rotating the magnetic impeller to mix the fluid in the mixing chamber.

Embodiments of the method can further comprise, for example, measuring or detecting a parameter of the fluid in the fluid mixing chamber (e.g., measuring the pH and/or the conductivity of the fluid) and/or sampling the fluid in the fluid mixing chamber and/or venting air from the mixer base assembly.

Advantageously, embodiments of the present invention provide a "clever base" that can be used with a variety of mixing vessels having different shapes and/or configurations. Homogenized mixing of a wide range of liquid volumes (e.g, about 35 ml to about 10,000 ml) and/or a liquids having wide range of viscosities (e.g., about 1 to about 25 Centipoise (cP)) can be achieved, while minimizing or eliminating splashing. Embodiments of the invention are particularly advantageous for applications such as for mixing heavy powders, as vortexes are formed, which assist in efficient mixing. Moreover, the use of a levitating magnetic impeller significantly reduces shear force, and eliminates rubbing of parts, thus reducing or eliminating particle shed that could contaminate the fluid.

Embodiments of the invention can be used with low volume mixing vessels, and if desired, can be connected to aseptic sampling devices (manual or automatic). If the mixing vessel does not have a vent filter, embodiments of the invention can include connection for a vent filter to maintain sterility and equilibrium of pressures within the system.

Preferably, the mixer base assembly is single-use.

Each of the components of the invention will now be described in more detail below, wherein like components have like reference numbers.

FIG. 1 is an exploded top view of an embodiment of the mixer base assembly according to the invention, wherein the mixer base assembly 500 is part of a mixing base system 1000.

The illustrated embodiment of the mixer base assembly 500 comprises a body 550 having an upper end 571 including a mating face 575 for mixing vessel/mixing vessel adapter connection; a lower end 572 including a cavity 557; a plurality of side walls (4 side walls 551A, 551B, 551C, 551D are illustrated; an inlet port 501 (shown in more detail in FIG. 3B) arranged in a side wall 551A (also showing an inlet port fitting 501A arranged in the inlet port); an outlet port 502 (having an entrance 502' and an exit 502") (the inlet and outlet ports can be separate components installed in the body or included in the body as a single injection molded part) passing through a different side wall 551C (also showing an outlet port fitting 502A arranged in the outlet port 502 as it passes (exits at 502") through the side wall); a sampling port 507 arranged in a side wall 551D (the illustrated port having external threads); at least one probe port arranged in a side wall 551C (two probe ports 518, 519 are illustrated, in some embodiments, the ports having internal threads, and probe adapters 818B and 819B have external threads, as well as o-rings (o-rings not shown)); and, a fluid mixing chamber 530 including a bottom wall 531 with a through hole 532; an interface plate 600 comprising an impeller seat 615, wherein the interface plate is arranged in the cavity 557 in the lower end of the body 572, the interface plate also including a top surface 601, a bottom surface 602 (for docking to the drive unit), a spindle 610, and a lip 612 wherein the impeller seat and lip are fluid tightly sealed to the bottom wall of the fluid mixing chamber through the through hole 532 (alternatively, the impeller seat can be included as part of the fluid mixing chamber); and a levitating rotating magnetic impeller 650 arranged in the impeller seat, the impeller comprising a base 652 including a magnet and having a central vertical opening 653 (for the spindle 610, providing an axis about which the impeller rotates) and at least two blades (four blades 651A, 651B, 651C, 651D are illustrated), wherein the blades extend above the bottom wall of the fluid mixing chamber into the fluid mixing chamber. As shown in more detail in FIG. 5, preferably, the bottom wall of the mixing chamber slopes downwardly toward the entrance 502' of the outlet port.

Figure 3A:
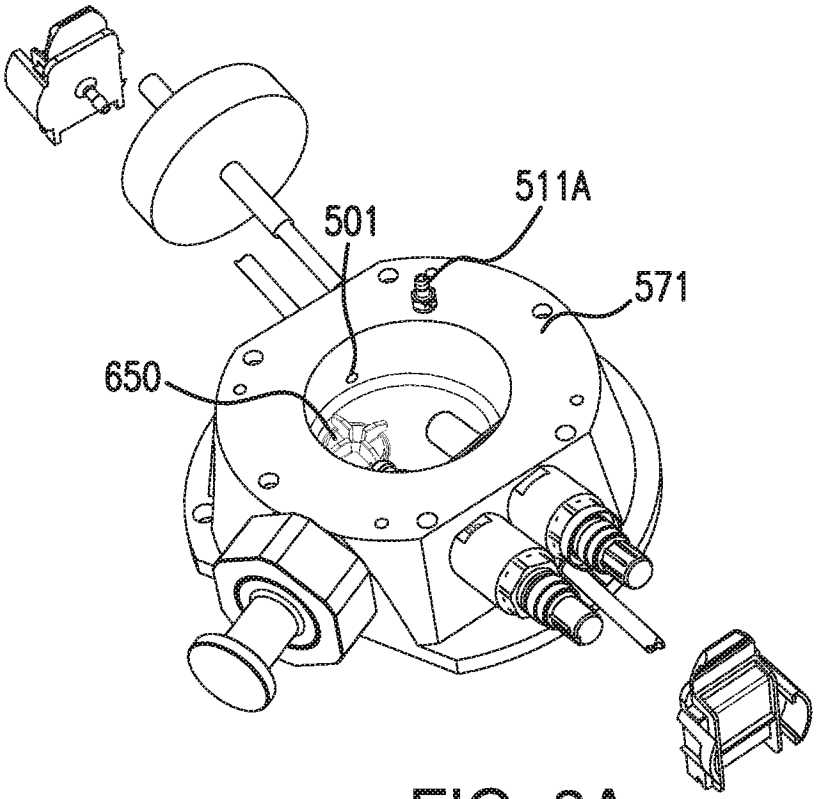
FIG. 3A is a top view of a portion of the mixer base assembly shown in FIG. 1, showing an inlet port communicating with the fluid mixing chamber.
Figure 2:
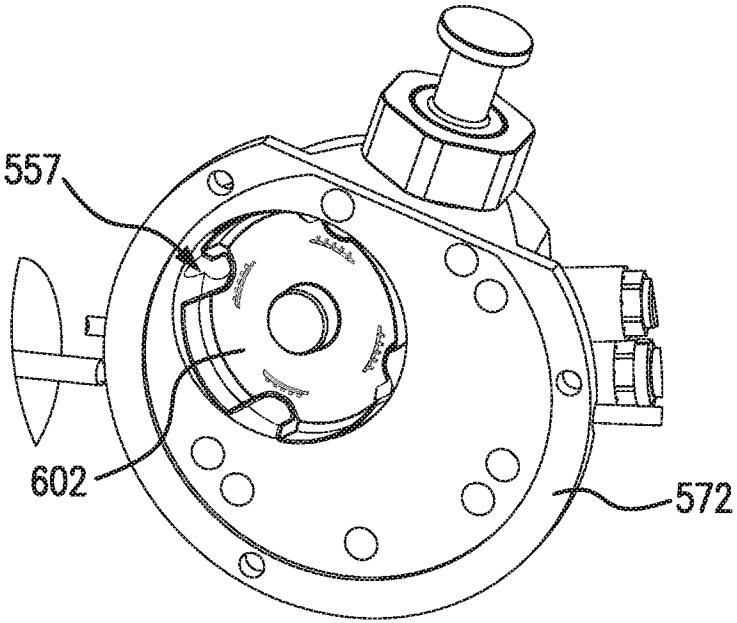
FIG. 2 is a bottom view of the mixer base assembly shown in FIG. 1.
Figure 3B:
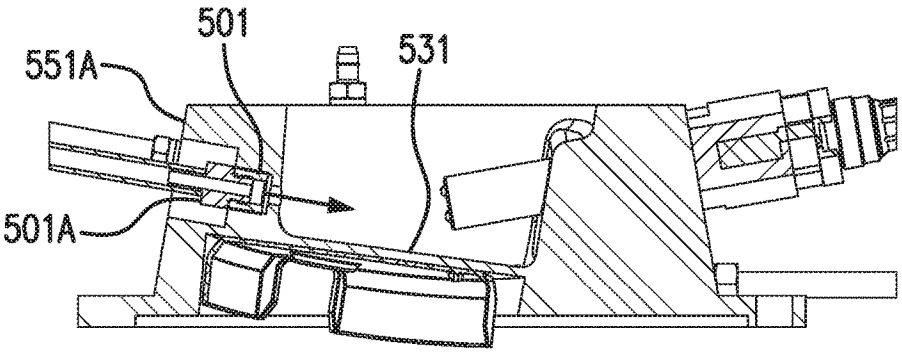
FIG. 3B is a cross-sectional view of the mixer base assembly shown in FIG. 3A, including an arrow showing the flow path of fluid through the inlet port into the fluid mixing chamber.
Figure 4A:
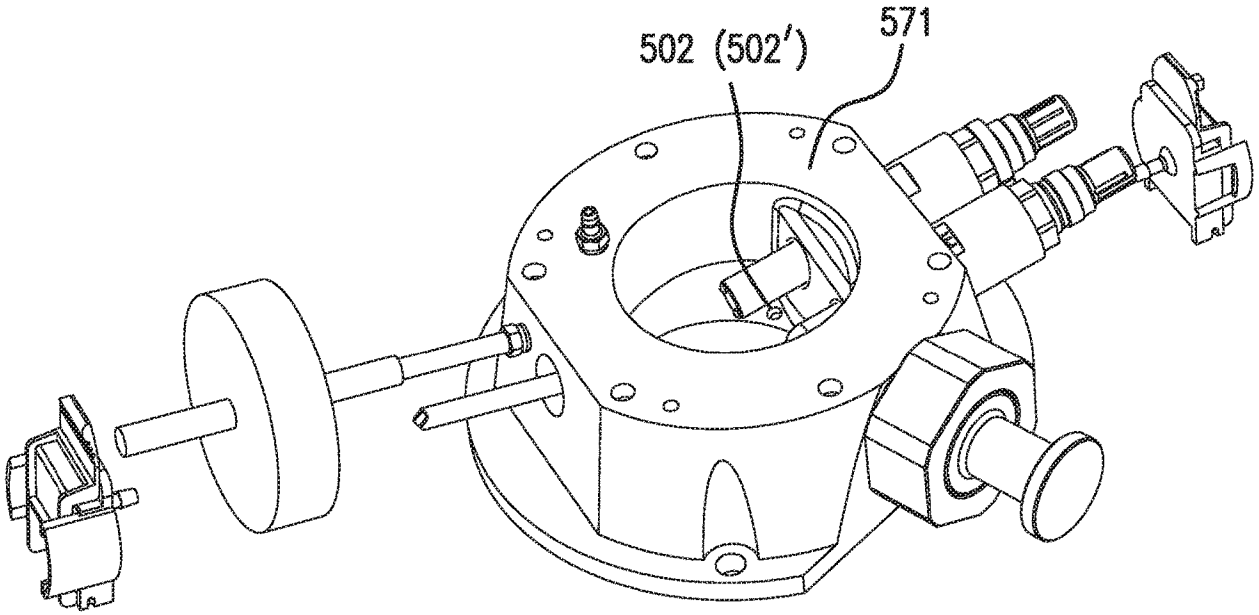
FIG. 4A is a top view of another portion of the mixer base assembly shown in FIG. 1, showing an outlet port communicating with the fluid mixing chamber.
Figure 4B:
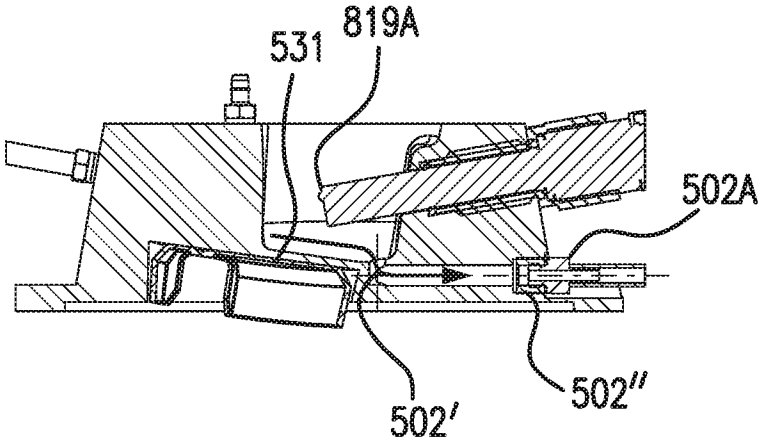
FIG. 4B is a cross-sectional view of the mixer base assembly shown in FIG. 4A, including an arrow showing the flow path of fluid through from the fluid mixture chamber and the outlet port.

As shown in FIGS. 3A-3B, fluid is preferably directed via the inlet port 501 to a lower part of the fluid mixing chamber to minimize splashing upon entry, and as shown in FIGS. 4A-4B, the outlet port 502 is positioned at a low point in the bottom wall and passes through the side wall to aid in full draining of the fluid mixture chamber.

Optionally, as shown in FIGS. 1 and 6, if a mixing vessel to be attached to the mixer base assembly does not include a vent, the mixer base assembly can further comprise a vent inlet port 511 (also showing a vent inlet port fitting 511A arranged in the vent inlet port) and a vent outlet port 512 (also showing a vent outlet port fitting 512A arranged in the vent outlet port), wherein the vent outlet port is arranged in a side wall of the body 551A, and the vent port is in communication (e.g., via a conduit 924) with a vent filter 912. A variety of vent filters are known in the art and are commercially available. The fittings 511A, 512A, conduit 924, and filter 912 can be included with an embodiment of the mixer base assembly, or can be included with an embodiment of the mixing base system.

If desired, embodiments of the mixing base system 1000 or the mixer base assembly can include a sampling arrangement 700 comprising a sample port plug 707 and sample port nut 707A, wherein the sample port plug 707 can be arranged in the sampling port 507. In some embodiments, the sampling arrangement is for use with a threaded connection such as, for example, a DN 25 threaded connection. If desired, an autosampling system can be installed through the sampling port 507 and/or manual sampling can be carried out through outlet port exit 502". Illustratively, samples can be taken offline to measure parameters that the probes are not reading or to confirm a probe reading or to calibrate a sensor.

Additionally, or alternatively, embodiments of the mixing base system 1000 or the mixer base assembly can include a connector system 900 comprising an inlet connector 201 and an outlet connector 202, such as aseptic connectors. A variety of connectors, including aseptic connectors, are commercially available, from, for example, Pall Corporation (Port Washington, N.Y., e.g., KLEENPAK® PRESTO); Cole-Parmer (Vernon Hills, Ill.); and Eldon James (Denver, Colo.).

Embodiments of the mixing base system or the mixer base assembly further comprise at least one probe 800, typically, two probes 818, 819 (in some embodiments probe adapters 818B and 819B are used to connect the probes to the probe ports), wherein FIG. 5 also shows the tips of two probes 818A, 819A arranged to sense fluid parameters of fluid in the fluid mixing chamber, preferably wherein the slope toward the outlet port minimizes hold-up volume (sometimes referred to as "carry-over volume") and/or helps create a taller height of fluid with a minimum volume to allow sensing of the fluid parameters. The Figure also shows that the tips of the probes are angled downwardly into the fluid mixing chamber. Advantageously, this allows positioning the tips as low as possible, and certain probes need to be positioned a few degrees above horizontal to operate correctly.

A variety of probes are suitable for use in embodiments of the invention, and are commercially available. Suitable probes include, for example, pH probes, conductivity probes, temperature sensors, dissolved oxygen probes, and cell counters.

The body can be fabricated from any suitable rigid impervious material, including any impervious thermoplastic material, which is compatible with the fluid being processed. For example, the housing can be fabricated from a metal, such as stainless steel, or from a polymer. In a preferred embodiment, the body is injection molded. The adapter plate is preferably plastic, and cannot be a magnetic material.

The mixer base assembly is connectable to a variety of mixing vessels (e.g., as shown in FIGS. 9A, 10A, 11A, and 12A).

FIG. 9A shows an embodiment of the mixer base assembly connectable to a commercially available rigid mixing vessel 1500A having threads 1501 at the bottom, allowing connection with a threaded mounting ring 1502 (having threads 1502A) that can be threaded to the bottom of the mixing vessel and mated (e.g., by pins or screws) to the mating face of the mixer base assembly; FIG. 9B shows an enlarged view of the threaded base of the mixing vessel and the mounting ring, FIGS. 9C and 9D show, respectively, a cross-sectional view, and a bottom perspective view, of the mounting ring 1502.

FIG. 10A shows an embodiment of the mixer base assembly connectable to a custom molded rigid mixing vessel 1500B having a base 1510 and a mounting flange 1511; FIG. 10B shows an enlarged view of the mounting flange 1511 at the bottom of the mixing vessel and the mating face of the mixer base assembly, wherein they can be mated together (e.g., by pins or screws); and FIG. 10C shows a perspective bottom view of the mounting flange 1511 at the bottom of the mixing vessel.

FIG. 11A shows an embodiment of the mixer base assembly connectable to a custom formed flexible mixing vessel (a biocontainer) 1500C arranged in a tote 1507, including a clamping arrangement 1525 comprising upper and lower sanitary flanges 1526A, 1526B, and a tri-clamp 1527; FIG. 11B shows an enlarged view of the upper sanitary flange 1526A and the tri-clamp 1527; and FIG. 11C shows an exploded view of the upper sanitary flange 1526A, the tri-clamp 1527, and the lower sanitary flange 1526B (that can be mated, e.g., by pins or screws) to the mating face of the mixer base assembly.

FIG. 12A shows an embodiment of the mixer base assembly connectable by an adapter to a custom vacuum formed mixing vessel 1500D having halves welded 1517A, 1517B together, wherein the vessel can be rigid or flexible; also showing a mating flange 1518 connectable to the bottom of the mixing vessel and an adapter 1519 for connecting the mating flange to the mixer base assembly; FIG. 12B shows an enlarged view of the mating flange 1518 and adapter 1519, FIG. 12C shows top perspective views of the mating flange 1518, adapter 1519, and a sealing ring 1521 providing a seal between the adapter and the mating face of the mixer base assembly; and FIG. 12D shows a bottom perspective view of the sealing ring 1521.

Mixing vessels can be docked to a variety of drive systems. Drive systems include a motor, an input/output (TO) module, a power supply, fans, wiring and connections, and, optionally, a weighing system, arranged in a housing.

FIGS. 13A-13D show an illustrative drive system 2500 comprising a motor 2000 (shown in FIGS. 13B and 13C); an I/O module 2100, DC-DC converters 2150A, 2150B and terminal blocks 2155 (mounted to a rail 2160), inlet and outlet fans 2175A, 2175B (FIG. 13D), a power receptacle

2190; a weighing system 2200 (shown including a weighing system cover 2201 and a weighing system load cell 2202 (FIGS. 13B and 13C), as well as a weighing system display 2203 and weighing system connector 2204 (FIG. 13D).

The illustrated housing 2300 includes a front cover 2301, a rear cover 2302, a top cover/mixer base support 2303, and a chassis 2304.

FIG. 13C shows a top cover gasket 2401 is mounted on top of the top cover/mixer base support 2303, and a mixer base assembly gasket 2402 is mounted on top of the motor 2000.

A variety of motors for magnetically levitating and spinning the impellers are known in the art. Commercially available motors include those available from Pall Corporation (Port Washington, N.Y.; e.g., LEVMIXER® SYSTEM) and Levitronix GmbH (Zurich, Switzerland).

The mating face of the mixer base assembly can be adapted for connection to a variety of size, shape, and/or type of mixing vessels, and the bottom surface of the interface plate can be adapted for docking to a variety of drive systems. In some embodiments, components and/or processes such as screws, pins, bolts, mounting rings, adapters, o-rings (with or without grooves or channels in the mating face), sanitary gaskets, and/or ultrasonic welding can be used for efficient connection. FIGS. 9B-9D, 10B-10C, 11B-11C, and 12B-12D show exemplary components and processes for connection, and FIG. 13C shows exemplary components for docking.

The following example further illustrates the invention but, of course, should not be construed as in any way limiting its scope.

EXAMPLE

This example demonstrates a decrease in impeller speed in forming a vortex using an embodiment of a mixer base assembly according to the invention (that does not have a baffle) compared to a mixer base assembly including a baffle as described in another application also entitled "MIXER BASE ASSEMBLY FOR MIXING VESSELS AND METHOD OF USE," filed as application Ser. No. 16/724,539 on Dec. 23, 2019.

Embodiments of mixing base assemblies as generally shown in FIG. 1 of each application are connected to a mixing vessel as generally shown in FIG. 10A, and tested using fill volumes (using water) of 100 mL (test 1), 5000 mL (test 2), and 10000 mL (test 3), with 3 runs for each test.

The results, showing the impeller speed at which the vortex forms (rpm) and the percent decrease for the mixer base assembly according to the embodiment of the invention compared to a mixer base assembly with a baffle are as follows:

| Base with baffle | | | | | Base without baffle | | | | |
|---|---|---|---|---|---|---|---|---|---|
| Fill vol. | Run 1 | Run 2 | Run 3 | Avg. | Run 1 | Run 2 | Run 3 | Avg. | % deer. |
| 100 | 400 | 350 | 350 | 366.7 | 250 | 250 | 250 | 250 | 32% |
| 5000 | 2100 | 2100 | 2100 | 2100 | 1000 | 1000 | 1000 | 1000 | 52% |
| 1000 | 4550 | 4550 | 4550 | 4500 | 1400 | 1400 | 1400 | 1400 | 69% |

This example shows that, depending on the volume tested, mixer base assemblies without baffles form a vortex at impeller speeds that are decreased by 32% to 69% compared to impeller speeds of mixer base assemblies with baffles.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A mixer base assembly comprising:

(a) a body having:

(i) an upper end including a mating face for mixing vessel connection;

(ii) a lower end including a cavity;

(iii) a plurality of side walls comprising a first side wall, a second side wall, a third side wall, and a fourth side wall;

(iv) an inlet port arranged in the first side wall;

(v) an outlet port arranged in the third side wall;

(vi) a sampling port arranged in the fourth side wall;

(vii) at least one probe port arranged in the third side wall; and, (viii) a fluid mixing chamber having a bottom wall;

(b) an impeller seat arranged in the cavity in the lower end of the body; and, (c) a levitating magnetic impeller arranged in the impeller seat, the levitating magnetic impeller comprising a magnet, a base, and at least two blades, wherein the at least two blades extend above the bottom wall of the fluid mixing chamber into the fluid mixing chamber.

2. The mixer base assembly of claim 1, further comprising a vent inlet port and a vent outlet port, wherein the vent outlet port is arranged in the first side wall of the body.

3. The mixer base assembly of claim 2, wherein the bottom wall of the mixing chamber slopes downwardly in a direction from the inlet port toward the outlet port.

4. The mixer base assembly of claim 3, further comprising at least one probe insertable into the at least one probe port.

5. The mixer base assembly of claim 3, further comprising a sampling arrangement comprising a sample port plug and a sample port nut, wherein the sample port plug is insertable into the sampling port.

6. The mixer base assembly of claim 2, further comprising at least one probe insertable into the at least one probe port.

7. The mixer base assembly of claim 6, further comprising a sampling arrangement comprising a sample port plug and a sample port nut, wherein the sample port plug is insertable into the sampling port.

8. The mixer base assembly of claim 2, further comprising a sampling arrangement comprising a sample port plug and a sample port nut, wherein the sample port plug is insertable into the sampling port.

9. The mixer base assembly of claim 1, wherein the bottom wall of the mixing chamber slopes downwardly in a direction from the inlet port toward the outlet port.

10. The mixer base assembly of claim 9, further comprising at least one probe insertable into the at least one probe port.

11. The mixer base assembly of claim 10, further comprising a sampling arrangement comprising a sample port plug and a sample port nut, wherein the sample port plug is insertable into the sampling port.

12. The mixer base assembly of claim 9, further comprising a sampling arrangement comprising a sample port plug and a sample port nut, wherein the sample port plug is insertable into the sampling port.

13. The mixer base assembly of claim 1, further comprising at least one probe insertable into the at least one probe port.

14. The mixer base assembly of claim 13, further comprising a sampling arrangement comprising a sample port plug and a sample port nut, wherein the sample port plug is insertable into the sampling port.

15. The mixer base assembly of claim 1, further comprising a sampling arrangement comprising a sample port plug and a sample port nut, wherein the sample port plug is insertable into the sampling port.

16. The mixer base assembly of claim 1, wherein the base of the levitating magnetic impeller includes a central vertical opening for a spindle, the mixer base assembly further comprising an interface plate arranged in the cavity in the lower end of the body, the interface plate including the spindle, wherein the levitating magnetic impeller rotates around the spindle.

17. A method for mixing fluid, the method comprising:

connecting a mixing vessel to a mixer base assembly comprising (a) a body having (i) an upper end including a mating face for mixing vessel connection; (ii) a lower end including a cavity; (iii) a plurality of side walls comprising a first side wall, a second side wall, a third side wall, and a fourth side wall; (iv) an inlet port arranged in the first side wall; (v) an outlet port arranged in the third side wall; (vi) a sampling port arranged in the fourth side wall; (vii) at least one probe port arranged in the third side wall; and, (viii) a fluid mixing chamber having a bottom wall; (b) an impeller seat arranged in the cavity in the lower end of the body; and, (c) a levitating magnetic impeller arranged in the impeller seat, the levitating magnetic impeller comprising a magnet, a base, and at least two blades, wherein the at least two blades extend above the bottom wall of the fluid mixing chamber into the fluid mixing chamber; and, introducing fluid into the fluid mixing chamber, and rotating the levitating magnetic impeller to mix the fluid in the fluid mixing chamber.

18. The method of claim 17, further comprising measuring the pH and/or conductivity of the fluid in the fluid mixing chamber.

19. The method of claim 18, further comprising sampling the fluid in the fluid mixing chamber.

20. The method of claim 17, further comprising sampling the fluid in the fluid mixing chamber.

21. The method of claim 17, wherein the base of the levitating magnetic impeller includes a central vertical opening for a spindle, the mixer base assembly further comprising an interface plate arranged in the cavity in the lower end of the body, the interface plate including the spindle, wherein the levitating magnetic impeller rotates around the spindle.

* * * * *